US008973594B2

(12) United States Patent
Burgess et al.

(10) Patent No.: US 8,973,594 B2
(45) Date of Patent: Mar. 10, 2015

(54) TENT PEG

(75) Inventors: Kirsty Burgess, Carine (AU); Edward Joseph Khoury, Bateman (AU)

(73) Assignee: Kirsty Burgess, Carine (AU)

( * ) Notice: Subject to any disclaimer, the term of this patent is extended or adjusted under 35 U.S.C. 154(b) by 29 days.

(21) Appl. No.: 13/261,624

(22) PCT Filed: Sep. 20, 2011

(86) PCT No.: PCT/AU2011/001214

§ 371 (c)(1),
(2), (4) Date: Mar. 21, 2013

(87) PCT Pub. No.: WO2012/037605

PCT Pub. Date: Mar. 29, 2012

(65) Prior Publication Data

US 2013/0233366 A1 Sep. 12, 2013

(30) Foreign Application Priority Data

Sep. 22, 2010 (AU) ..... 2010904274

(51) Int. Cl.
*E04H 15/62* (2006.01)

(52) U.S. Cl.
CPC ..... *E04H 15/62* (2013.01)
USPC ..... 135/118; 135/120.4; 52/156; 114/294

(58) Field of Classification Search
CPC ..... E04H 12/2215; E04H 15/62; E04H 15/64; B63B 21/20; B63B 21/22; B63B 21/24; F24J 2/525
USPC ..... 135/118–119, 120.3–120.4; 248/156, 248/508, 545, 87–88; 403/389; 119/786; 114/294–295, 301, 218; 52/155–156
See application file for complete search history.

(56) References Cited

U.S. PATENT DOCUMENTS

| | | | | | |
|---|---|---|---|---|---|
| 2,870,884 | A * | 1/1959 | Mazur | 52/158 |
| 3,280,829 | A * | 10/1966 | Glendenning et al. | 135/118 |
| 3,534,751 | A * | 10/1970 | Peters | 135/118 |
| 3,995,820 | A * | 12/1976 | Einhorn | 248/216.1 |
| 5,243,795 | A * | 9/1993 | Roberts | 52/158 |
| 5,390,916 | A * | 2/1995 | Govoni | 473/282 |
| D376,756 | S * | 12/1996 | Adams | D8/382 |
| 5,667,174 | A * | 9/1997 | Adams | 248/156 |
| 6,938,384 | B1 * | 9/2005 | Hodge | 52/155 |
| 6,997,199 | B1 * | 2/2006 | Wright | 135/118 |
| 7,302,904 | B2 * | 12/2007 | Burns | 114/294 |
| 2007/0256721 | A1 * | 11/2007 | Spain | 135/119 |
| 2012/0049036 | A1 * | 3/2012 | Colesanti | 248/508 |

* cited by examiner

*Primary Examiner* — Winnie Yip
(74) *Attorney, Agent, or Firm* — Tope-McKay & Associates

(57) ABSTRACT

Described is tent peg that provides easy storage and transport to reduce the likelihood of the tent peg being lost. The tent peg comprises a shaft having and a head comprising a body having an arm extending therefrom. The arm comprises a first aperture adjacent to the body and a second aperture located between the first aperture and a distal end of the arm. The first aperture is formed to receive a shaft of a first further tent peg in an opposite orientation. Additionally, the second aperture is formed to receive a shaft of a second further tent peg in the same orientation as the tent beg. Further, the shaft of the second further tent peg is receivable in a first aperture of the first further tent peg. Therefore, multiple tent pegs can be interconnected with each tent peg in the opposite orientation to the adjacent tent pegs.

14 Claims, 7 Drawing Sheets

TENT PEG

FIELD OF THE INVENTION

The present invention relates to tent pegs.

BACKGROUND TO THE INVENTION

Tent pegs used for securing down a tent are commonly lost either in use or transport. After use, the tent pegs can be left in the ground due to being hard to locate among grass or other ground cover. For the tent pegs that are located and removed, the pegs are often simply placed in a pile while the tent is being dismantled. The pegs are then usually collected and placed in a bag for transport. This process can also result in the loss of tent pegs, which may not be noticed until next time the tent is to be used.

The present invention relates to tent pegs aimed at providing easier storage and transport and reducing the likelihood of the pegs being lost.

SUMMARY OF THE INVENTION

According to one aspect of the present invention there is provided a tent peg comprising a shaft and a head, wherein the head comprises a body having an arm extending therefrom and the arm includes a first aperture adjacent the body and a second aperture located between the first aperture and a distal end of the arm such that the shaft of a first further tent peg is receivable in the first aperture of the tent peg in an opposite orientation, the shaft of a second further tent peg is receivable in the second aperture in the same orientation as the tent peg and wherein the shaft of the second further tent peg is receivable in the first aperture of the first further tent peg.

Preferably, the second aperture comprises an elongate aperture for receiving the shafts of two further tent pegs such that the shaft of a third further tent peg is receivable through the second aperture in an opposite orientation to the tent peg and also through the second aperture of the first further tent peg and the first aperture of the second further tent peg.

Preferably the arm extends generally radially from the cylindrical body and includes a first portion extending from the body generally perpendicularly from the longitudinal axis of the shaft and a second portion extending at an angle to the first portion, the second portion being angled towards the second end of the shaft.

Preferably the first portion includes the first aperture and the second portion includes the second aperture.

In one embodiment, the body comprises a cylindrical body having a longitudinal aperture therein for receiving the shaft and the shaft includes a widened end portion received and secured in use within the cylindrical body.

The body preferably includes a narrowed neck portion such that the shaft can slide through aperture but the neck portion restricts passage of the widened end of the shaft.

In a preferred embodiment, the top of the widened end protrudes above the body of the head such that the top may be struck by a tool for driving the tent peg into the ground.

The head is preferably constructed of a plastic material and the shaft is preferably constructed of metal.

Preferably the head is constructed of a brightly coloured material and/or a material that glows in the dark.

BRIEF DESCRIPTION OF THE DRAWINGS

The invention will now be described, by way of example, with reference to the following drawings.

DETAILED DESCRIPTION OF PREFERRED EMBODIMENTS

Figure 1:
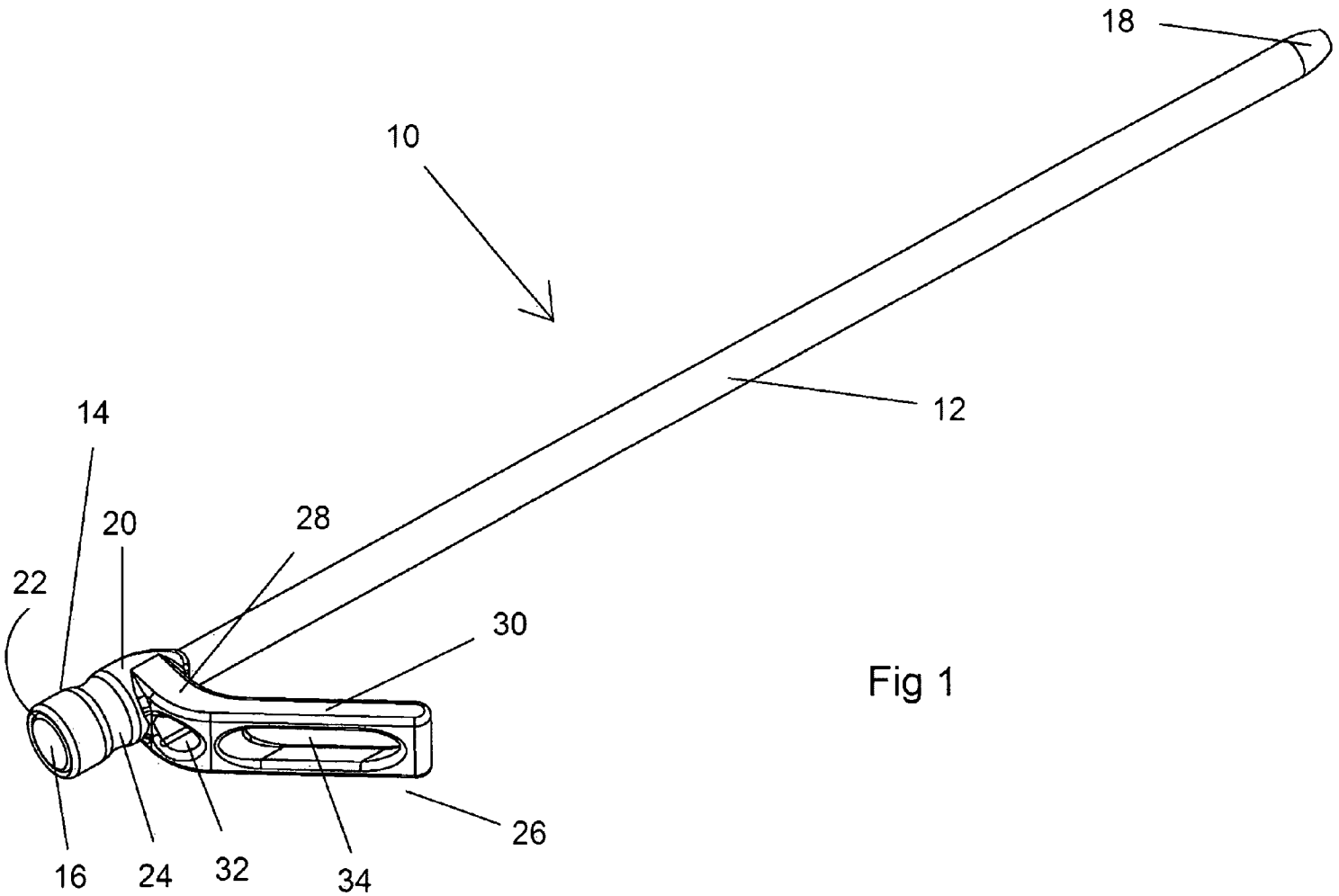
FIG. 1 is a perspective view of a tent peg in accordance with the present invention.

Referring to the Figures, there is shown a tent peg 10 comprising a shaft 12 and a head 14. In the embodiment shown, the shaft 12 and the head 14 are separate components connectable together to form the tent peg 10. It will be appreciated however that the shaft 12 and head 14 may be integrally formed.

The shaft 12 comprises an elongate spike of suitable material, such as metal. The shaft 12 includes a widened end 16 at a first end thereof and a tapered portion 18 at a second end. The tapered portion 18 is provided for being driven into the ground.

The head 14 includes a body 20 having a longitudinal aperture 22 therein. In the embodiment shown, the body 20 comprises a cylindrical body. The longitudinal aperture 22 is provided for receiving the shaft 12. The shaft 12 is inserted into the aperture 22 with the second end first. The body 20 includes a narrowed neck portion 24 such that the shaft 12 can slide through aperture 22 but the neck portion 24 restricts passage of the widened end 16 of the shaft 12. The widened end 16 of the shaft 12 is therefore retained within the body 12 adjacent a first end thereof.

The widened end 16 of the shaft 12 is accessible through the first end of the body 12 such that the widened end 16 can be struck with a suitable implement, such as a hammer, in order to drive the tent peg 10 into the ground. That is, the top of the widened end 16 protrudes above the body 20 of the head 14. As the impact is taken by the widened end 16 of the shaft 12, the head 14 may be constructed of a material of lesser strength, such as plastic. The head 14 is preferably constructed of a brightly coloured plastic to make the tent pegs 10 easier to see when in the ground. The head 14 may also be constructed of a material that glows in the dark.

The head 14 includes an arm 26 extending outwardly therefrom. The arm 26 in the embodiment shown extends outwardly from the head 24 between a second end of the body 20 and the neck portion 24. The arm 26 extends generally radially from the cylindrical body 20.

The arm 26 comprises a first portion 28 and a second portion 30. The first portion 28 extends from the body 20 generally perpendicularly from the longitudinal axis of the shaft 12. The second portion 30 extends at an angle to the first portion 28, being angled towards the second end of the shaft 12. In use, the arm 26 traps a rope secured around the tent peg 10 between the arm 26 and the ground in a known manner.

The arm 26 includes at least one aperture for receiving the shaft of a further tent peg 10 such that a plurality of tent pegs 10 can be secured together when not in use.

The arm 26 of the tent peg 10 includes a first aperture 32 provided in the first portion 28 of the arm 26 adjacent the body 20. The first aperture 32 is provided for receiving the second end of a first further tent peg 10'. The second end of the first further tent peg 10' is inserted into the first aperture 32 from a side adjacent the second end of the body 20 such that the head 14 of the first further tent peg 10' is located adjacent the second end 18 of the shaft 14. That is, the first further tent peg 10' is arranged in the opposite direction.

The arm 26 includes also a second aperture 34 in the second portion 18 thereof. The second aperture 34 is provided between the first aperture 32 and the distal end of the arm 26. The second aperture 34 comprises an elongate aperture such that the shafts 12 of two further tent pegs can be received in the second aperture 34.

Figure 2:
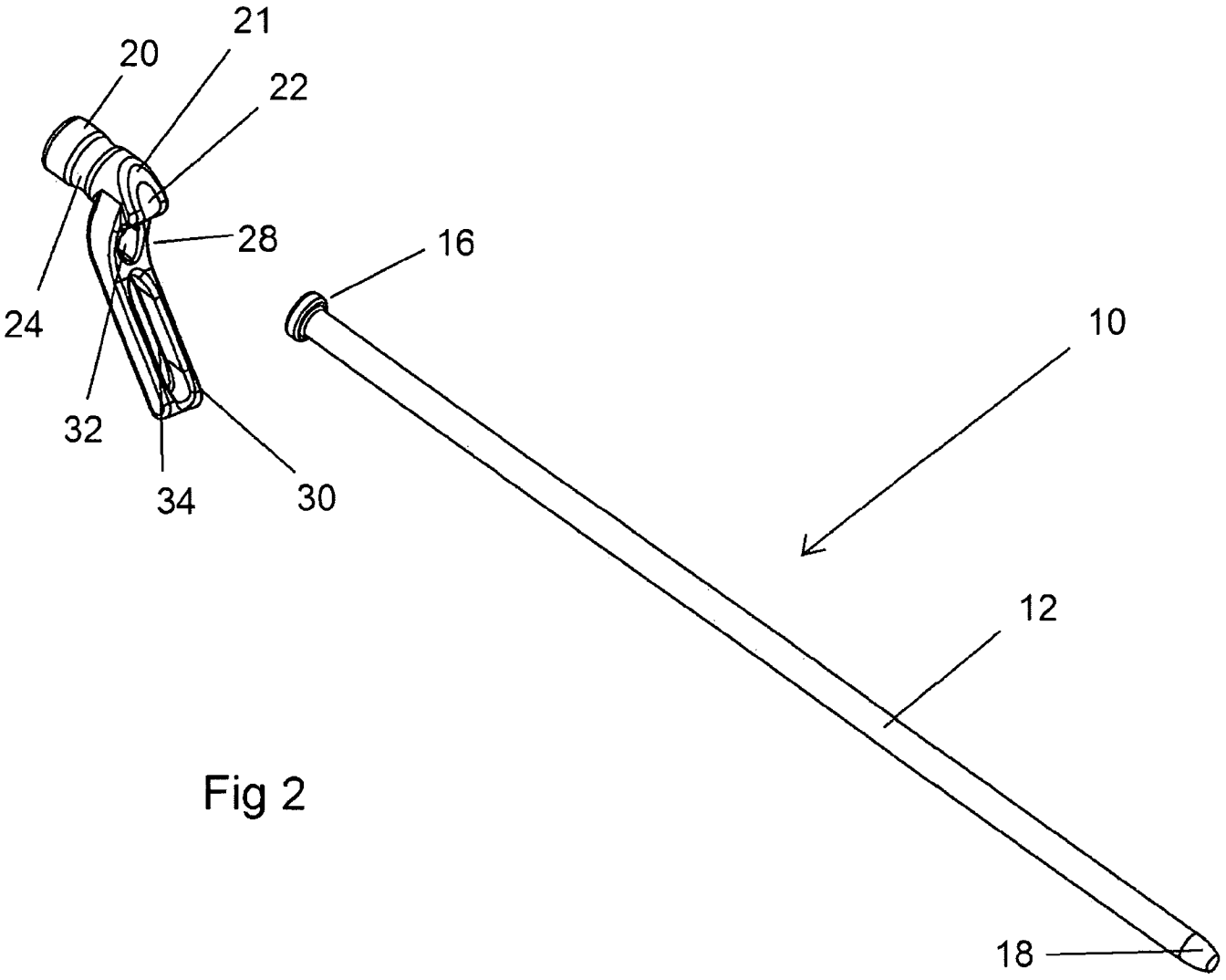
FIG. 2 is an exploded view of the tent peg of FIG. 1.
Figure 3A:
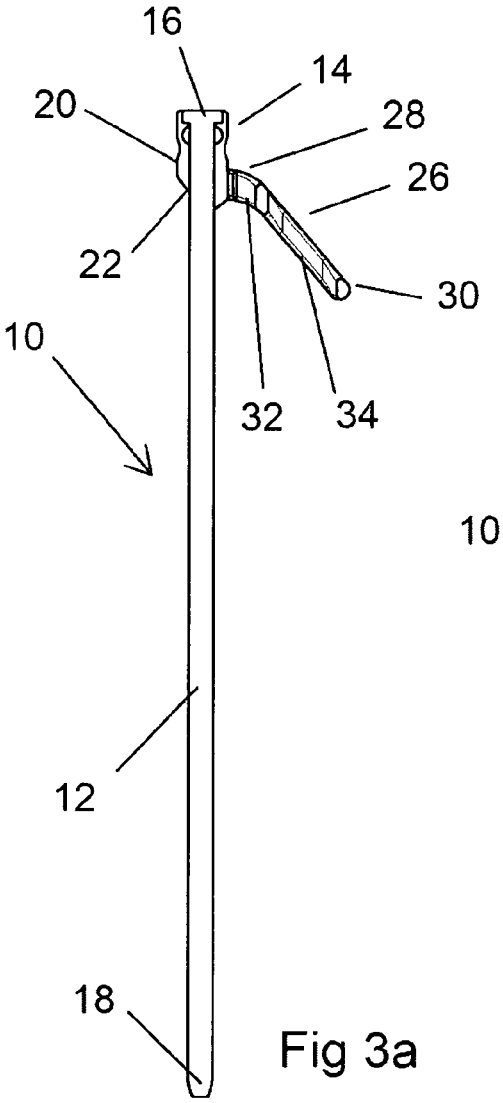
FIG. 3*a* is a side cross sectional view of the tent peg of FIG. 1.
Figure 3B:
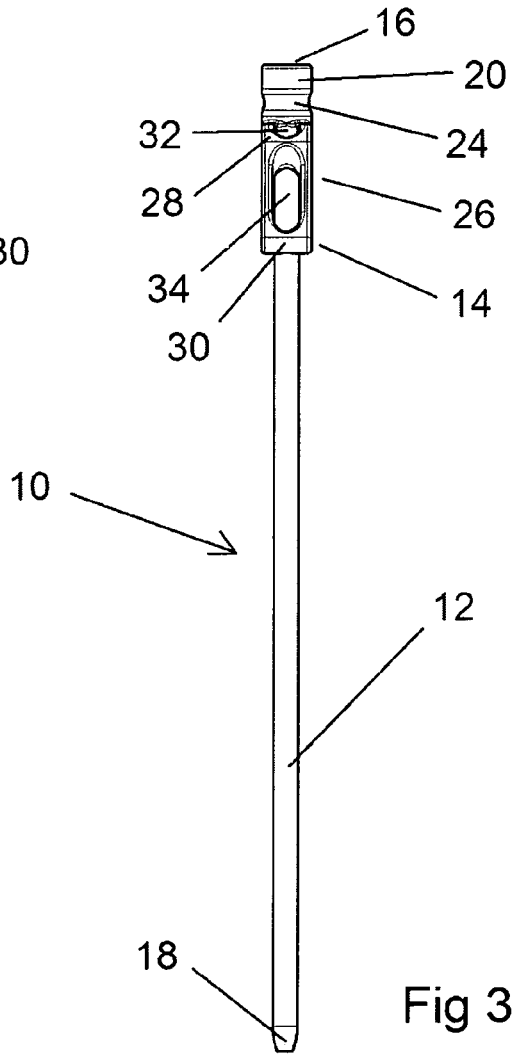
FIG. 3*b* is a front view of the tent peg of FIG. 1.
Figure 4A:
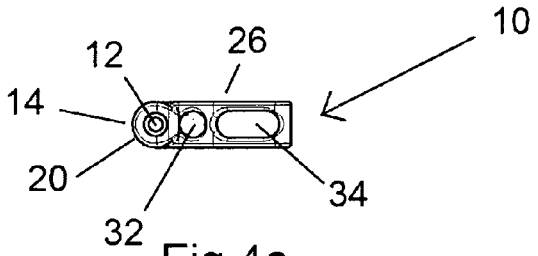
FIG. 4*a* is a top view of the tent peg of FIG. 1.
Figure 4B:
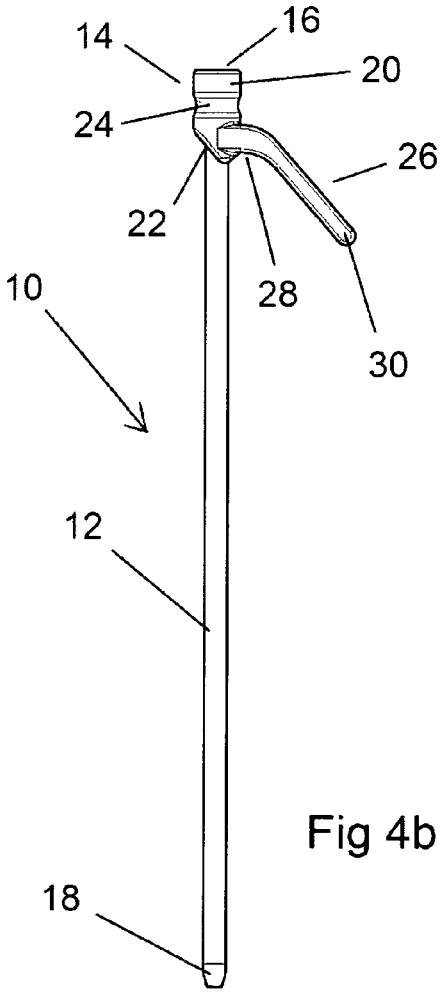
FIG. 4*b* is a side view of the tent peg of FIG. 1.
Figure 4C:
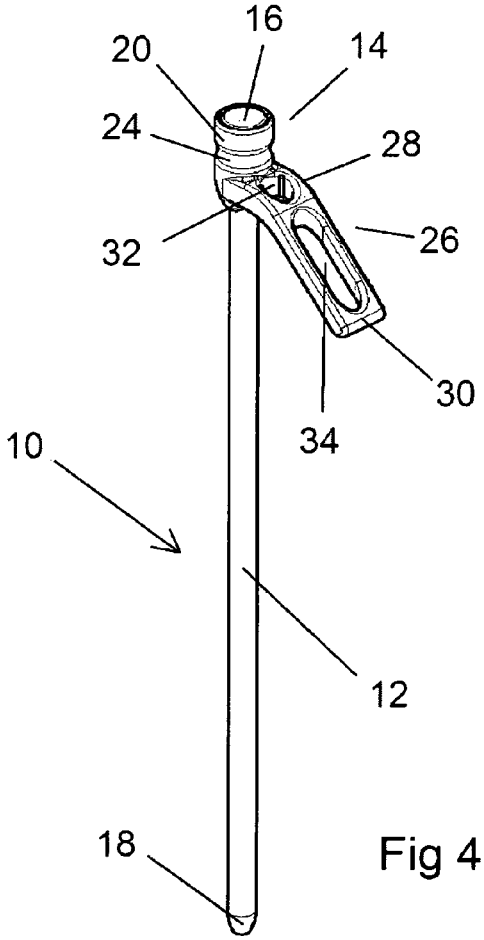
FIG. 4*c* is an upper perspective view of the tent peg of FIG. 1.

As described above, a first further tent peg 10' is received in the first aperture 32 oriented in the opposite direction. A second further tent peg 10" is then oriented in the same direction as the initial tent peg 10 and the shaft 12 thereof inserted through the second aperture 34. The shaft 12 of the second further tent peg 10" is also received through the first aperture 32 of the first further tent peg 10'. An end of the cylindrical body 20 of the head 14 is provided with a tapered side 21 (as can be seen in FIG. 2). The tapered side 21 is provided at an angle being the same as that of the second portion 30 of the arm 26 such that the tapered side 21 rests flat against the arm 26.

A third further tent peg 10''' is then oriented in the same direction as the first further tent peg 10' and inserted through the second aperture 34 of the first further tent peg 10'. The shaft 12 of the third further tent peg 10''' is also received in the second aperture 34 of the initial tent peg 10 and the first aperture 32 of the second further tent peg 10".

Figure 5:
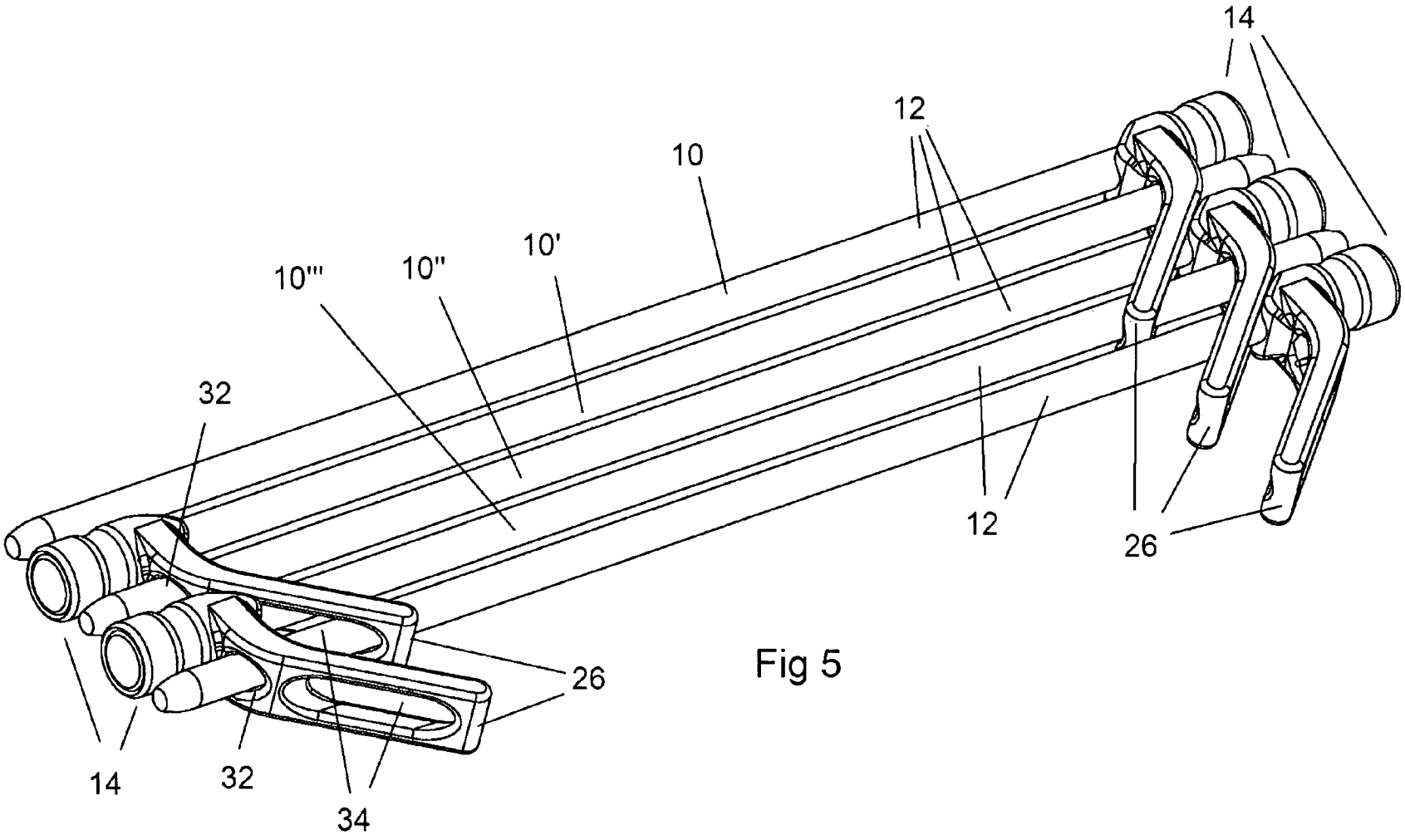
FIG. 5 is a perspective view of a plurality of the tent pegs of FIG. 1 interconnected.

In this way, a plurality of tent pegs 10 can be interconnected (as shown in FIG. 5) with each tent peg 10 in the opposite orientation to the adjacent tent pegs 10. The arm 26 of each of the tent pegs 10 receives the shafts 12 of three further tent pegs 10. The interlocking of multiple further tent pegs 10 into the arm 26 of each tent peg 10 creates a single planar row of interconnected tent pegs 10 that form a relatively rigid structure.

Figure 6:
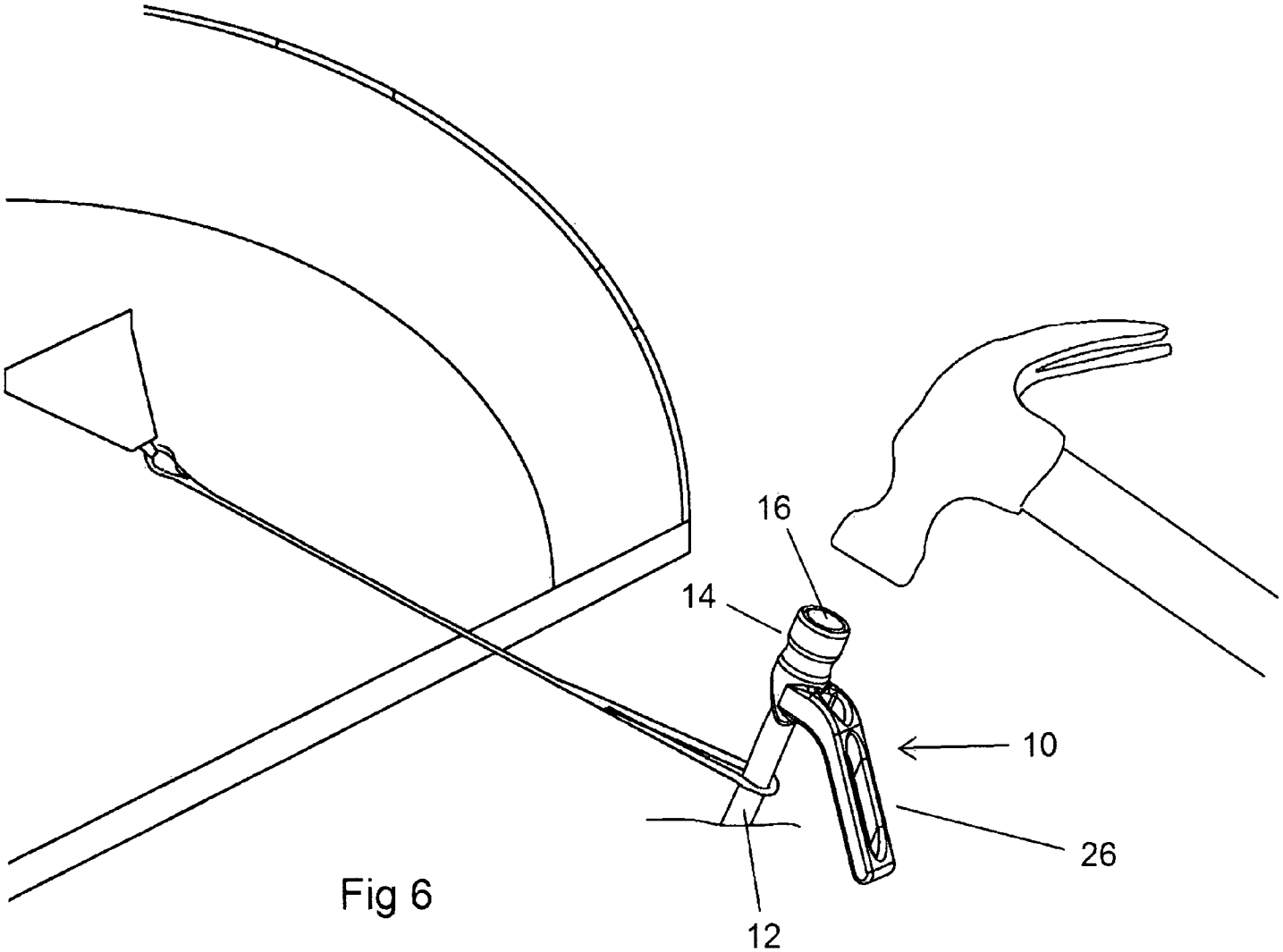
FIG. 6 is a perspective view showing installation of one of the tent pegs of FIG. 1.
Figure 7:
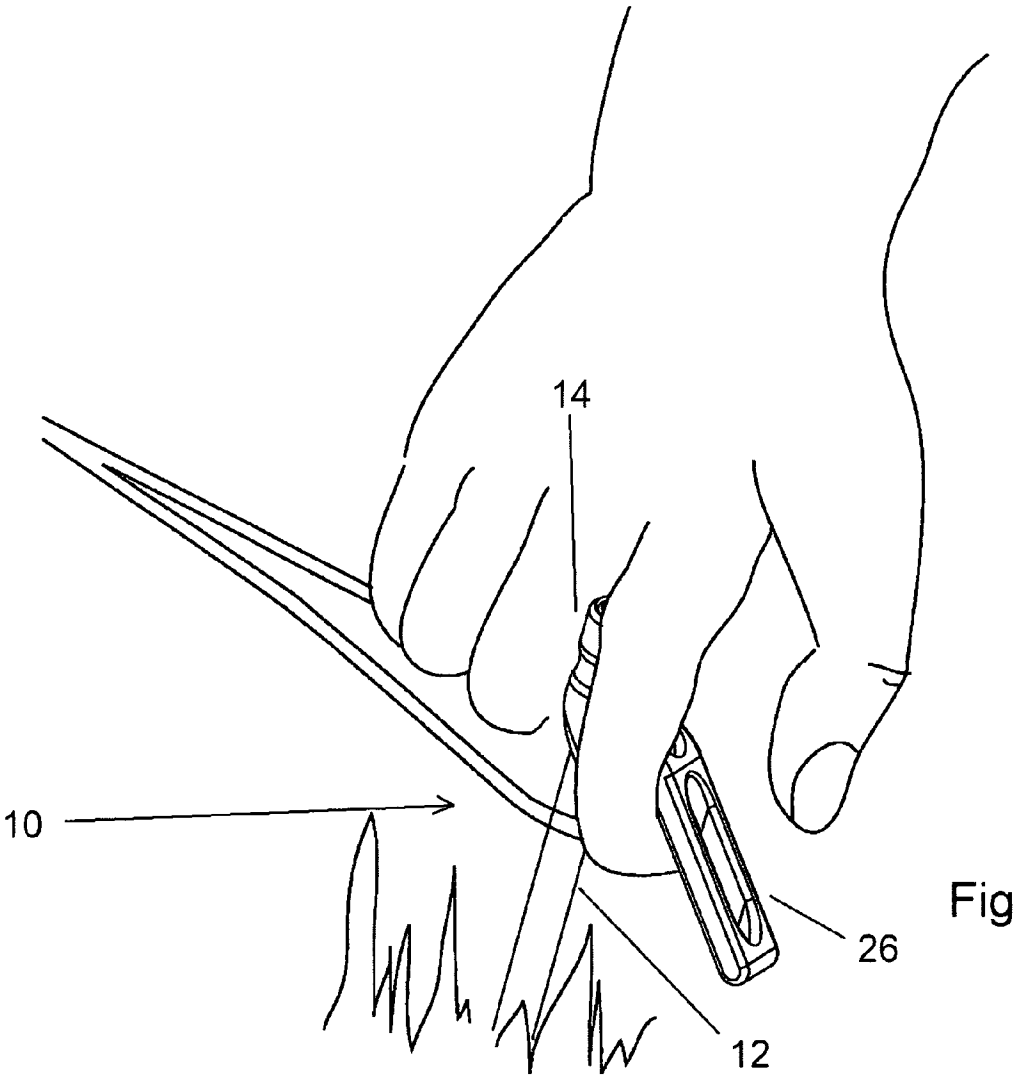
FIG. 7 is a perspective view showing removal of one of the tent pegs of FIG. 1.

In use, the tent pegs 10 can be inserted into the ground and used in the normal manner of tent pegs (as shown in FIG. 6). Each tent peg 10 may be removed by grasping the head 14 of the tent peg 10 and pulling it from the ground (as shown in FIG. 7). The brightly coloured or glowing heads 14 will aid the ability to locate each of the tent pegs 10.

Each time a tent peg 10 is removed it may be interconnected to the previously removed tent pegs 10 as described above. In this way, the tent pegs 10 are retained together in a single structure, reducing the likelihood of the tent pegs 10 becoming lost.

It will be readily apparent to persons skilled in the relevant arts that various modifications and improvements may be made to the foregoing embodiments, in addition to those already described, without departing from the basic inventive concepts of the present invention.

What is claimed is:

1. A tent peg comprising:

a shaft having a first end, a second end, and a longitudinal axis extending between the first end and the second end;

a head comprising a body having an arm extending therefrom, the arm having a distal end and a proximal end;

wherein the arm comprises a first portion extending from the body substantially perpendicularly from the longitudinal axis of the shaft, the first portion including a first aperture, and a second portion extending at an angle to the first portion towards the second end of the shaft, the second portion including a second aperture;

wherein the first aperture is formed to receive a shaft of a first further tent peg in an opposite orientation;

wherein the second aperture is formed to receive a shaft of a second further tent peg in the same orientation as the tent peg; and wherein the shaft of the second further tent peg is receivable in a first aperture of the first further tent peg.

2. The tent peg as set forth in claim 1, wherein the second aperture comprises an elongate aperture for receiving the shafts of two further tent pegs such that the shaft of a third further tent peg is receivable through the second aperture in an opposite orientation to the tent peg and also through the second aperture of the first further tent peg and the first aperture of the second further tent peg.

3. The tent peg as set forth in claim 2, wherein the body comprises a cylindrical body having a longitudinal aperture therein for receiving the shaft, and the shaft comprises a widened end portion received and secured in use within the cylindrical body.

4. The tent peg as set forth in claim 3, wherein the body comprises a narrowed neck portion such that the shaft can slide through the longitudinal aperture, but the narrowed neck portion restricts passage of the widened end portion of the shaft.

5. The tent peg as set forth in claim 4, wherein a top of the widened end portion protrudes above the body of the head such that the top of the widened end portion may be struck by a tool for driving the tent peg into the ground.

6. The tent peg as set forth in claim 5, wherein the head is constructed of a plastic material, and the shaft is constructed of a metal material.

7. The tent peg as set forth in claim 6, wherein the head is constructed of a material selected from the group consisting of brightly colored materials and materials that glow in the dark.

8. The tent peg as set forth in claim 3, wherein a top of the widened end portion protrudes above the body of the head such that the top of the widened end portion may be struck by a tool for driving the tent peg into the ground.

9. The tent peg as set forth in claim 3, wherein the head is constructed of a material selected from the group consisting of brightly colored materials and materials that glow in the dark.

10. The tent peg as set forth in claim 4, wherein the head is constructed of a material selected from the group consisting of brightly colored materials and materials that glow in the dark.

11. The tent peg as set forth in claim 5, wherein the head is constructed of a material selected from the group consisting of brightly colored materials and materials that glow in the dark.

12. The tent peg as set forth in claim 2, wherein the head is constructed of a material selected from the group consisting of brightly colored materials and materials that glow in the dark.

13. The tent peg as set forth in claim 1, wherein the body comprises a cylindrical body having a longitudinal aperture therein for receiving the shaft, and the shaft comprises a widened end portion received and secured in use within the cylindrical body.

14. The tent peg as set forth in claim 1, wherein the head is constructed of a material selected from the group consisting of brightly colored materials and materials that glow in the dark.

* * * * *